US005636524A

United States Patent [19]

Woods et al.

[11] Patent Number: 5,636,524

[45] Date of Patent: Jun. 10, 1997

[54] METHOD FOR ISOLATING MATERIAL FROM MELTED ICE WATER

[76] Inventors: Margaret H. Woods; John T. Woods, both of P.O. Box 9138, Palm Springs, Calif. 92263

[21] Appl. No.: 270,925

[22] Filed: Jul. 5, 1994

[51] Int. Cl.[6] ..... F25D 3/08

[52] U.S. Cl. ..... 62/459; 62/463; 62/464

[58] Field of Search ..... 62/245, 422, 423, 62/459, 463, 464

[56] References Cited

U.S. PATENT DOCUMENTS

| | | | |
|---|---|---|---|
| 1,421,913 | 7/1922 | Collins | 62/422 X |
| 2,252,225 | 8/1941 | Bonsall | 62/245 |
| 2,557,004 | 6/1951 | Lepper | 62/245 |
| 2,802,347 | 8/1957 | Marcus | 62/459 X |
| 4,177,652 | 12/1979 | Volk | 62/422 X |
| 4,787,532 | 11/1988 | Borjesson | 62/459 X |
| 5,052,184 | 10/1991 | Jarvis | 62/459 X |

FOREIGN PATENT DOCUMENTS

| | | | |
|---|---|---|---|
| 419 | 2/1926 | Australia | 62/459 |

*Primary Examiner*—William E. Tapolcai

[57] ABSTRACT

The instant invention consists of a device similar to an inverted shallow basket with a myriad of openings through which water and air may pass easily. The device, when placed into an ice chest, holds the items in the chest up out of the melted ice water, thereby keeping the items from contamination and spoilage.

1 Claim, 1 Drawing Sheet

METHOD FOR ISOLATING MATERIAL FROM MELTED ICE WATER

TECHNICAL FIELD

The invention pertains to a method of isolating food and other materials which are placed in an atmospheric cooler commonly known as an ice chest. This device holds all manner of items off the bottom of an ice chest, so that when the ice placed in the cooler to keep the contents cold or cool melts the resulting water does not contaminate the other contents. This invention may also contain a sponge type material to absorb the water, so the water will not splash and contaminate the contents.

BACKGROUND ART

Ice chests in all shapes and sizes have been used for years to protect perishable materials while transporting or just storing them. Other than selfcontained freezable and reusable cooling blocks, plain water ice, as different from dry ice, is the most universally utilized cooling media. Most of this ice is purchased in one to five pound bags. This ice is either placed in and around the perishables or the whole bag of ice is placed into the cooler together with the other contents without opening the bag. Either way, after awhile, the ice melts and the resultant water ends up in the bottom of the cooling unit and may contaminate and ruin the perishable contents.

The instant invention is a device which forms a false bottom, raised above the actual bottom of the chest, but of open construction so that water will flow through it. This device will allow the water to collect at the bottom of the chest while holding all other contents up out of the water thus eliminating contamination and or spoilage. With the addition of a sponge like material, the melting water will be kept from splashing and in turn contaminating the contents.

DISCLOSURE OF THE INVENTION

Prior art is probably as varied as the number of persons who used and presently use ice chests, and, therefore, prior art is beyond cataloging. To the best knowledge of the inventors, no product has been created for the exact purpose of holding the contents of an ice chest up out of the melted ice water in the bottom of said chest. The instant invention consists of a device which is shaped like an inverted shallow basket of open weave, which though not very deep will hold the contents of an ice chest up out of the melted ice water. This device should conform to the size and shape of the ice chest in plan view, but this is not absolutely necessary. The resultant device may consist also of one or a myriad of units of the same or different configuration which are utilized to hold the contents of an ice chest up and out of melted ice water. The invention may include or incorporate a sponge like material inside the basket configuration to absorb the melted water and prevent the water from contaminating the contents of the ice chest.

BEST METHOD OF CARRYING OUT THE INVENTION

Figure 1:
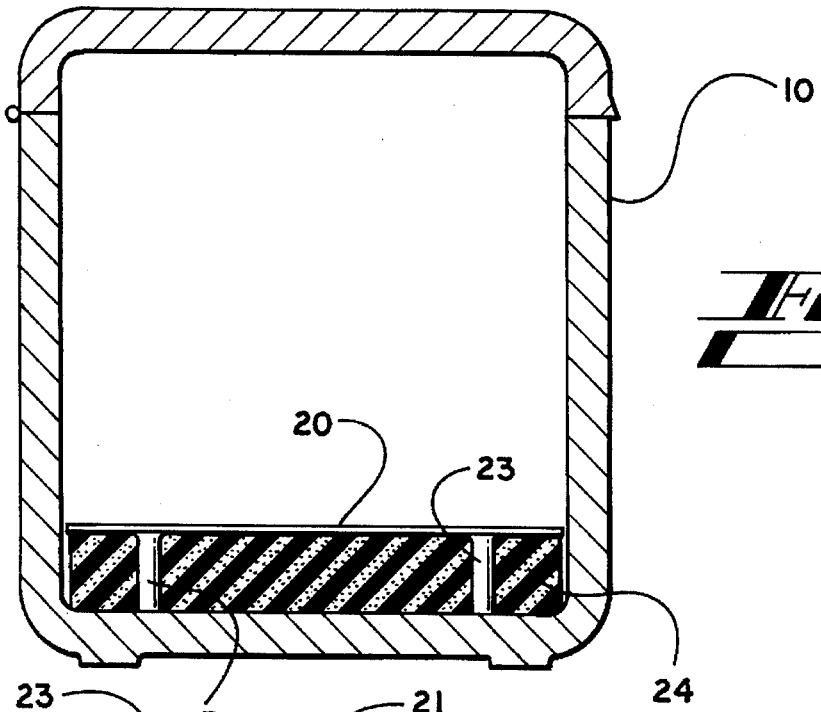
FIG. 1 shows a cross section of an ice chest with the device of the invention in place.
Figure 2:
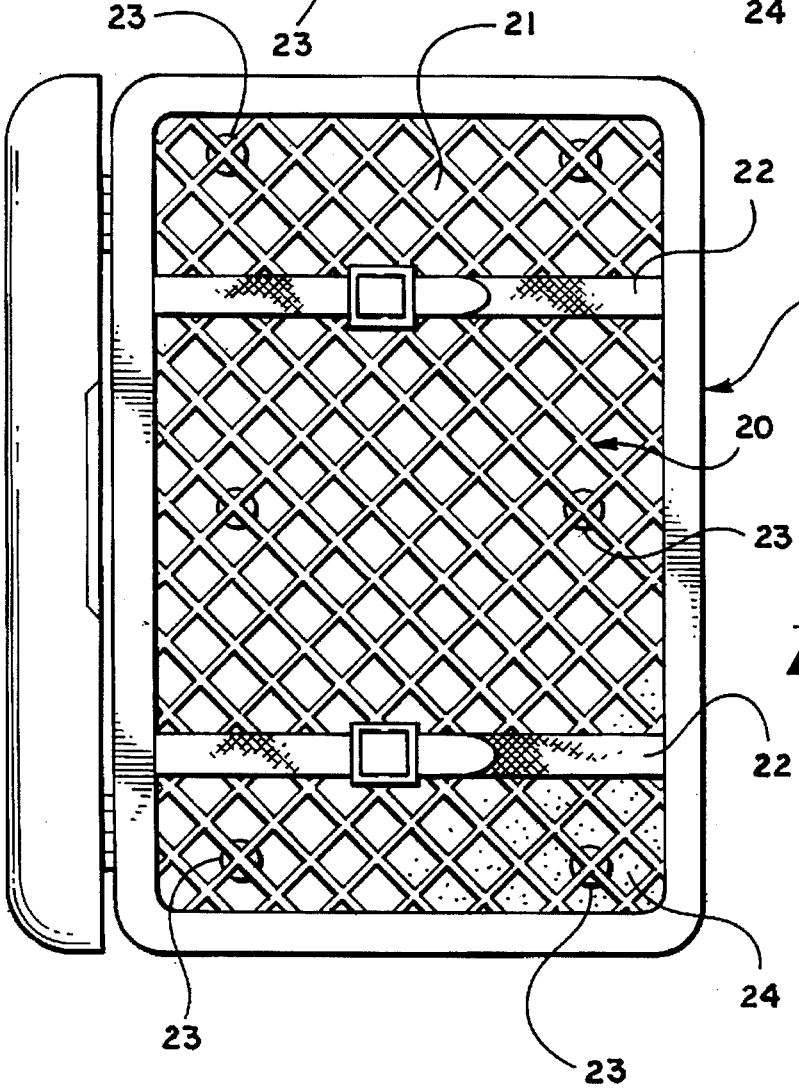
FIG. 2 shows a plan view of the ice chest with the device.

The best method for carrying out the invention is to mold or otherwise quickly and cheaply fabricate a light weight inverted basket type device (20) which has a myriad of openings in the top and sides (ends) (21) which will allow free flow of air and water through the devise and yet will be strong enough to support any items which may be placed upon it inside of an ice chest. (10) The device should also fit snugly into the ice chest (10) so as to preclude items slipping down between the device (20) and the ice chest (10) and thereby being contaminated by the melted ice water in the bottom of the chest. The basket like device (20) may also have straps (22) which will facilitate holding a bag of ice in place. Alternately, a series of legs (23) may serve the same function to not only hold the bag of ice in place but to keep the basket raised sufficiently high above the ice and water. The inclusion of sponge type material (24) inside the inverted basket will absorb the melted ice water to keep the water from splashing up and contaminating the cooler contents. The sponge material (24) is removable for wringing out, washing, and drying when not in use.

FIG. I shows a cross section of an ice chest (10) with the device of instant invention (20) in place. The open structure (21) is shown. Straps (22) may be incorporated to temporarily hold the ice bag and the sponge in place and stilts or legs (23) may be employed to keep the platform high enough to hold the contents out of melted ice water. The sponge like material (24) is also seen in the cross section view. FIG. II shows the ice chest (10) with the device (20) in plane view. The ends of the straps (22) and also the sponge material (23) are also visible.

We claim:

1. An ice chest comprising, in combination:

(a) side walls and a bottom wall for providing a storage space therein;

(b) an inverted basket having sides and a top with a plurality of openings therein, the basket fitting snugly within the ice chest and resting on the bottom thereof;

(c) sponge means removably attached to the basket for absorbing water from melted ice that is placed in the ice chest for cooling the items placed therein;

(d) strap means for removably attaching the sponge means to the basket;

(e) wherein, in use, the sponge means is attached to the basket with the straps, and then the basket is placed inverted in the ice chest, and ice or other coolant is placed on top of the basket along with items to be cooled.

* * * * *